US009784133B2

(12) United States Patent
Karafillis et al.

(10) Patent No.: US 9,784,133 B2
(45) Date of Patent: Oct. 10, 2017

(54) TURBINE FRAME AND AIRFOIL FOR TURBINE FRAME

(71) Applicant: General Electric Company, Schenectady, NY (US)

(72) Inventors: Apostolos Pavlos Karafillis, Winchester, MA (US); Martin Wayne Frash, Newburyport, MA (US); Schuyler Javier Ortega, Peabody, MA (US); Angelo Parisi, Nahant, MA (US)

(73) Assignee: General Electric Company, Schenectady, NY (US)

( * ) Notice: Subject to any disclaimer, the term of this patent is extended or adjusted under 35 U.S.C. 154(b) by 247 days.

(21) Appl. No.: 14/676,385

(22) Filed: Apr. 1, 2015

(65) Prior Publication Data

US 2016/0290169 A1 Oct. 6, 2016

(51) Int. Cl.

*F01D 25/24* (2006.01)
*F01D 25/16* (2006.01)
*F01D 9/04* (2006.01)

(52) U.S. Cl.

CPC ..... *F01D 25/246* (2013.01); *F01D 9/041* (2013.01); *F01D 9/042* (2013.01); *F01D 25/162* (2013.01); *F05D 2220/32* (2013.01); *F05D 2240/12* (2013.01); *F05D 2240/14* (2013.01)

(58) Field of Classification Search

CPC ..... F01D 25/246; F01D 9/041; F01D 9/042; F01D 25/162; F05D 2220/32; F05D 2240/12; F05D 2240/14

USPC ..... 415/209.4

See application file for complete search history.

(56) References Cited

U.S. PATENT DOCUMENTS 94,162 A * 8/1869 Wolf et al. ..... F03B 3/00 415/161
3,237,918 A * 3/1966 Le Bell ..... F01D 17/162 415/156
4,793,770 A 12/1988 Schonewald et al.
4,897,020 A * 1/1990 Tonks ..... F01D 5/186 415/115
4,993,918 A * 2/1991 Myers ..... F01D 25/162 415/191

(Continued)

FOREIGN PATENT DOCUMENTS

CN 101153546 A 4/2008
CN 103195573 A 7/2013

(Continued)

OTHER PUBLICATIONS

European Search Report issued in connection with corresponding Application No. 16163348.2 dated Jul. 25, 2016.

(Continued)

*Primary Examiner* — Dwayne J White
*Assistant Examiner* — Aaron R Eastman
(74) *Attorney, Agent, or Firm* — General Electric Company; William Scott Andes

(57) ABSTRACT

A turbine frame for a turbine engine having an axial centerline, the turbine frame comprising an inner hub, an outer hub encircling the inner hub, a plurality of struts extending between the inner and outer hubs and having a maximum width portion relative to the axial centerline and an airfoil comprising at least first and second fairings mounted to the inner and outer hubs and encircling one of the struts.

20 Claims, 6 Drawing Sheets

(56) References Cited

U.S. PATENT DOCUMENTS

| | | | | |
|---|---|---|---|---|
| 5,020,318 | A * | 6/1991 | Vdoviak | F01D 9/065 60/226.1 |
| 5,332,357 | A * | 7/1994 | Tubbs | F01D 5/147 415/115 |
| 5,357,744 | A | 10/1994 | Czachor et al. | |
| 5,634,767 | A | 6/1997 | Dawson | |
| 5,931,636 | A * | 8/1999 | Savage | F01D 17/141 415/115 |
| 5,941,537 | A * | 8/1999 | Wallace | F01D 5/148 277/628 |
| 6,439,841 | B1 | 8/2002 | Bosel | |
| 6,672,833 | B2 | 1/2004 | MacLean et al. | |
| 6,983,608 | B2 | 1/2006 | Allen, Jr. et al. | |
| 8,152,451 | B2 * | 4/2012 | Manteiga | F01D 9/02 415/115 |
| 2003/0161716 | A1 | 8/2003 | Nguyen et al. | |
| 2004/0088989 | A1 * | 5/2004 | Dowman | F01D 17/162 60/772 |
| 2010/0104432 | A1 | 4/2010 | Hasselqvist et al. | |
| 2010/0132374 | A1 * | 6/2010 | Manteiga | F01D 9/02 60/796 |
| 2010/0135777 | A1 | 6/2010 | Manteiga et al. | |
| 2010/0303608 | A1 | 12/2010 | Kataoka et al. | |
| 2011/0302929 | A1 * | 12/2011 | Bruhwiler | F01D 9/044 60/796 |
| 2013/0167552 | A1 | 7/2013 | Keny et al. | |
| 2013/0336782 | A1 | 12/2013 | Ryczek et al. | |
| 2014/0178187 | A1 | 6/2014 | Sakekar et al. | |
| 2014/0352313 | A1 * | 12/2014 | Schott | F02C 7/04 60/751 |
| 2016/0290168 | A1 | 10/2016 | Karafillis et al. | |

FOREIGN PATENT DOCUMENTS

| | | | |
|---|---|---|---|
| JP | 2005180418 | A | 7/2005 |
| JP | 2015524533 | A | 8/2015 |
| WO | 2014022358 | A1 | 2/2014 |
| WO | 2014197037 | A2 | 12/2014 |

OTHER PUBLICATIONS

European Search Report issued in connection with related Application No. 16162943.1 dated Jul. 25, 2016.

U.S. Appl. No. 14/676,246, filed Apr. 1, 2015, Karafillis, Apostolos Pavlos.

Japanese Search Report issued in connection with corresponding JP Application No. 2016-062961 dated Mar. 28, 2017.

Office Action issued in connection with corresponding JP Application No. 2016-062961 dated Apr. 4, 2017.

U.S. Non-Final Rejection issued in connection with related U.S. Appl. No. 14/676,246 dated Mar. 3, 2017.

Unofficial English Translation of Chinese Office Action issued in connection with corresponding CN Application No. 201610198591.7 dated Mar. 3, 2017.

U.S. Non-Final Office Action issued in connection with related U.S. Appl. No. 14/676,246 dated Mar. 3, 2017.

* cited by examiner

TURBINE FRAME AND AIRFOIL FOR TURBINE FRAME

BACKGROUND OF THE INVENTION

Turbine engines, and particularly gas or combustion turbine engines, are rotary engines that extract energy from a flow of combusted gases passing through the engine onto a multitude of turbine blades. Gas turbine engines typically include a stationary turbine frame supporting a plurality of circumferentially spaced vanes having an airfoil shape, which are exposed to high temperatures in operation. It is desirable to increase operating temperatures within gas turbine engines as much as possible to increase both output and efficiency.

To protect struts of the turbine frame from the high temperatures, a one-piece wraparound fairing can be used. This configuration requires the struts be separable from the frame assembly at the hub, outer ring or both to permit fairing installation over the struts. This makes installation and field maintenance difficult. A split fairing arrangement in which forward and aft sections are sandwiched around the struts can be used but relies on an interlocking feature to keep the fairing halves together after assembly to the frame. This interlocking feature consumes a significant amount of physical space and is therefore is less desirable for use with many frame configurations as it increases aerodynamic blockage.

BRIEF DESCRIPTION OF THE INVENTION

In one aspect, an embodiment of the invention relates to an airfoil for a turbine frame having inner and outer hubs connected by a plurality of struts with a maximum width portion relative to an axial center of the turbine frame, the airfoil comprising, at least first and second fairings connected together along first and second join lines to form the airfoil and define an interior sized to receive one of the struts when the first and second fairings are mounted to the turbine frame, wherein the first join lines are located such that the first join line is forward of the maximum width portion and the second join line is aft of the maximum width portion when the first and second fairings are mounted to the turbine frame and a strut is received within the interior.

In another aspect, an embodiment of the invention relates to a turbine frame for a turbine engine having an axial centerline, the turbine frame includes an inner hub, an outer hub encircling the inner hub, a plurality of struts extending between the inner and outer hubs and having a maximum width portion relative to the axial centerline, an airfoil comprising at least first and second fairings mounted to the inner and outer hubs and encircling one of the struts, and abutting along first and second join lines, with the first join line located axially forward of the second join line.

DESCRIPTION OF EMBODIMENTS OF THE INVENTION

Figure 1:
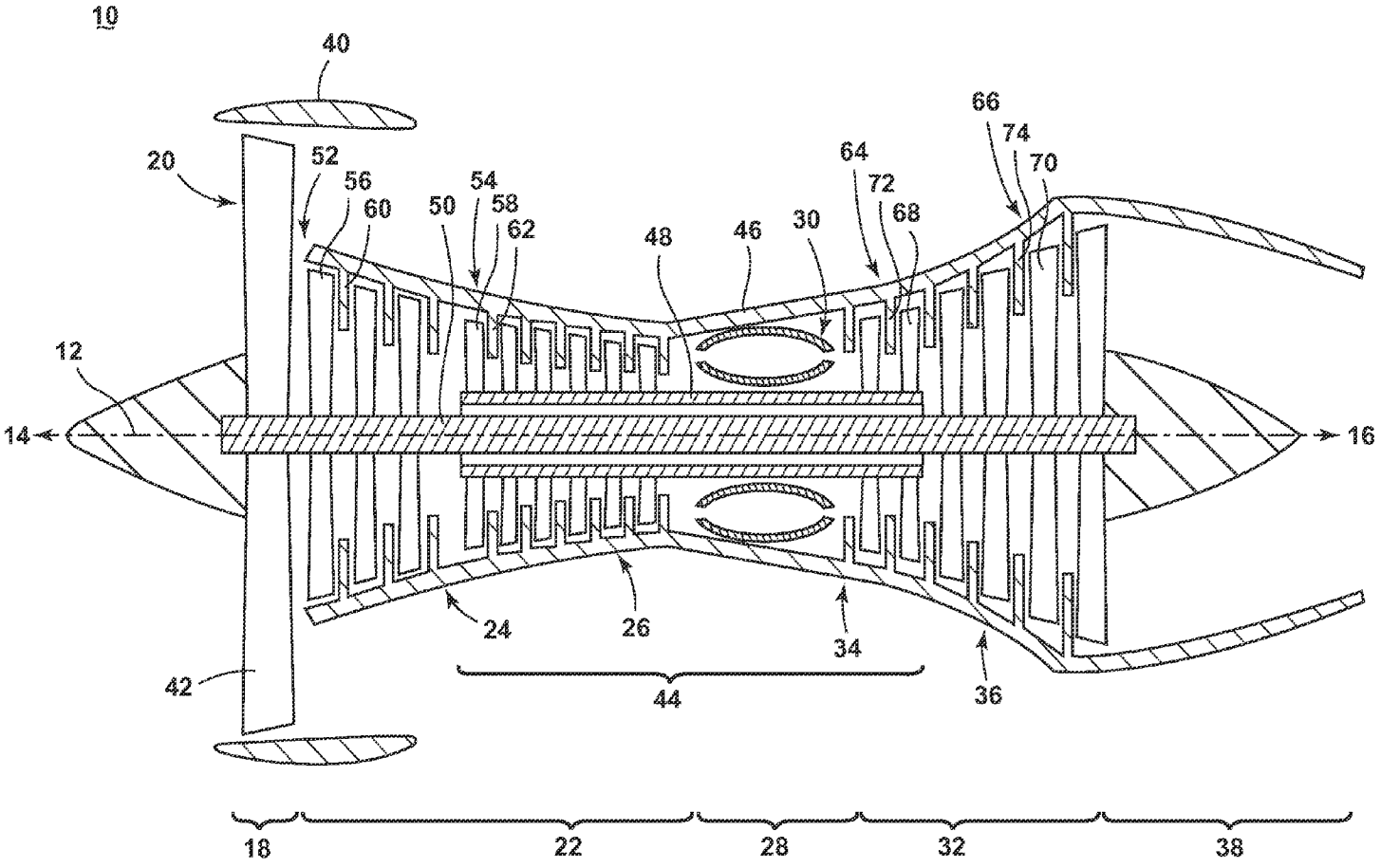
FIG. 1 is a schematic cross-sectional diagram of a gas turbine engine for an aircraft.

For purposes of explaining the environment of embodiments of the invention, FIG. 1 illustrates a gas turbine engine 10 for an aircraft. The engine 10 has a generally longitudinally extending axis or centerline 12 extending forward 14 to aft 16. The engine 10 includes, in downstream serial flow relationship, a fan section 18 including a fan 20, a compressor section 22 including a booster or low pressure (LP) compressor 24 and a high pressure (HP) compressor 26, a combustion section 28 including a combustor 30, a turbine section 32 including a HP turbine 34, and a LP turbine 36, and an exhaust section 38.

The fan section 18 includes a fan casing 40 surrounding the fan 20. The fan 20 includes a plurality of fan blades 42 disposed radially about the centerline 12.

The HP compressor 26, the combustor 30, and the HP turbine 34 form a core 44 of the engine 10 which generates combustion gases. The core 44 is surrounded by a core casing 46 which can be coupled with the fan casing 40. A HP shaft or spool 48 disposed coaxially about the centerline 12 of the engine 10 drivingly connects the HP turbine 34 to the HP compressor 26. A LP shaft or spool 50, which is disposed coaxially about the centerline 12 of the engine 10 within the larger diameter annular HP spool 48, drivingly connects the LP turbine 36 to the LP compressor 24 and fan 20.

The LP compressor 24 and the HP compressor 26 respectively include a plurality of compressor stages 52, 54, in which a set of compressor blades 56, 58 rotate relative to a corresponding set of static compressor vanes 60, 62 (also called a nozzle) to compress or pressurize the stream of fluid passing through the stage. In a single compressor stage 52, 54, multiple compressor blades 56, 58 may be provided in a ring and may extend radially outwardly relative to the centerline 12, from a blade platform to a blade tip, while the corresponding static compressor vanes 60, 62 are positioned downstream of and adjacent to the rotating blades 56, 58.

The HP turbine 34 and the LP turbine 36 respectively include a plurality of turbine stages 64, 66, in which a set of turbine blades 68, 70 are rotated relative to a corresponding set of static turbine vanes 72, 74 (also called a nozzle) to extract energy from the stream of fluid passing through the stage. In a single turbine stage 64, 66, multiple turbine blades 68, 70 may be provided in a ring and may extend radially outwardly relative to the centerline 12, from a blade platform to a blade tip, while the corresponding static turbine vanes 72, 74 are positioned upstream of and adjacent to the rotating blades 68, 70.

In operation, the rotating fan 20 supplies ambient air to the LP compressor 24, which then supplies pressurized ambient air to the HP compressor 26, which further pressurizes the ambient air. The pressurized air from the HP compressor 26 is mixed with fuel in combustor 30 and ignited, thereby generating combustion gases. Some work is extracted from these gases by the HP turbine 34, which drives the HP compressor 26. The combustion gases are discharged into the LP turbine 36, which extracts additional work to drive the LP compressor 24, and the exhaust gas is ultimately discharged from the engine 10 via the exhaust section 38. The driving of the LP turbine 36 drives the LP spool 50 to rotate the fan 20 and the LP compressor 24.

Some of the ambient air supplied by the fan 20 may bypass the engine core 44 and be used for cooling of portions, especially hot portions, of the engine 10, and/or used to cool or power other aspects of the aircraft. In the context of a turbine engine, the hot portions of the engine are normally downstream of the combustor 30, especially the turbine section 32, with the HP turbine 34 being the hottest portion as it is directly downstream of the combustion section 28. Other sources of cooling fluid may be, but is not limited to, fluid discharged from the LP compressor 24 or the HP compressor 26.

Figure 2:
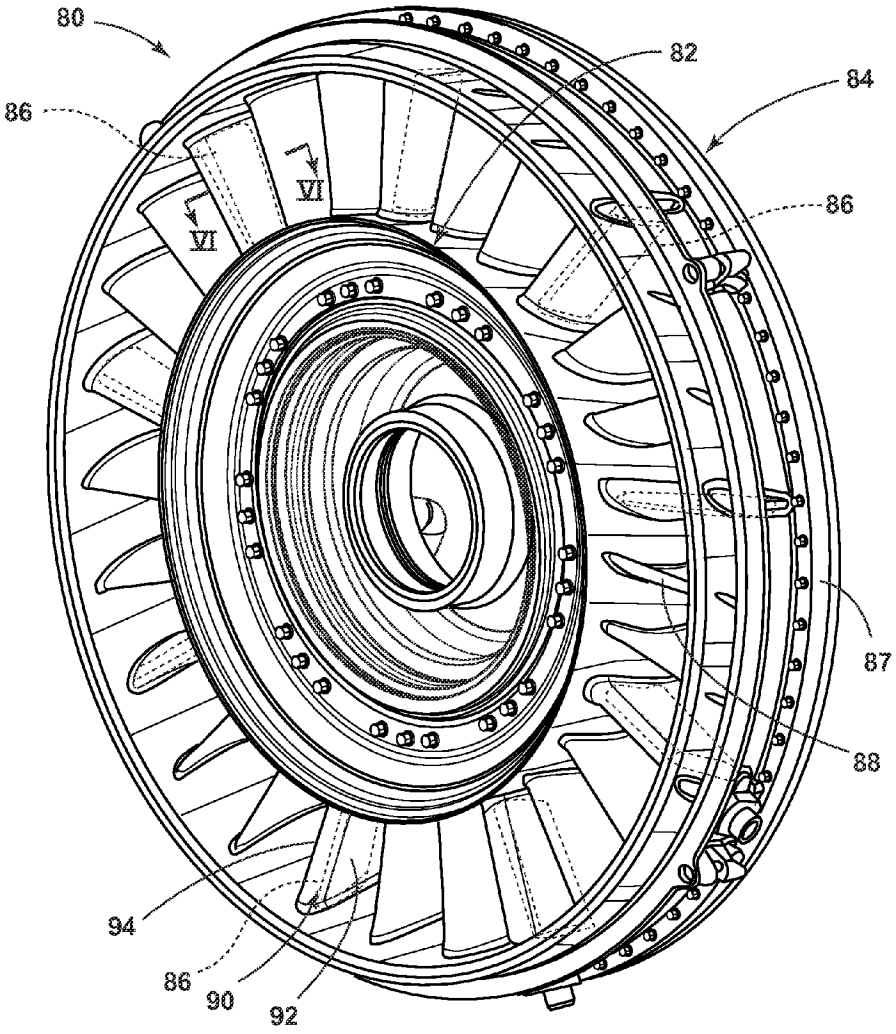
FIG. 2 is a perspective view of a turbine exhaust frame of the engine from FIG. 1.

FIG. 2 illustrates the structural details of an exhaust frame 80 supporting the LP/HP turbine vanes 72, 74 of FIG. 1. So as not to limit what section of the turbine the exhaust frame 80 may be utilized in, the vanes in the remaining figures have been given alternative numerals. It will be understood however that if the exhaust frame was for the high pressure turbine, then it would correspond to turbine vanes 72 and if the exhaust frame was for the low pressure turbine, then the vanes of the exhaust frame would correspond to the low pressure vanes 74.

The exhaust frame 80 may provide a structural load path from bearings, which support the rotating shafts of the engine 10 to an outer casing of the engine 10. The exhaust frame 80 crosses the combustion gas flow path of the turbine section 32 and is thus exposed to high temperatures in operation. An inner hub 82, an outer hub 84 encircling the inner hub 82, and a plurality of struts 86 (shown in phantom) extending between the inner hub 82 and the outer hub 84 may be included in the exhaust frame 80. Conduits 83 may run through some of the struts 86 and additional structures such as hangers and retainers 87 may be included in the exhaust frame 80.

Figure 3:
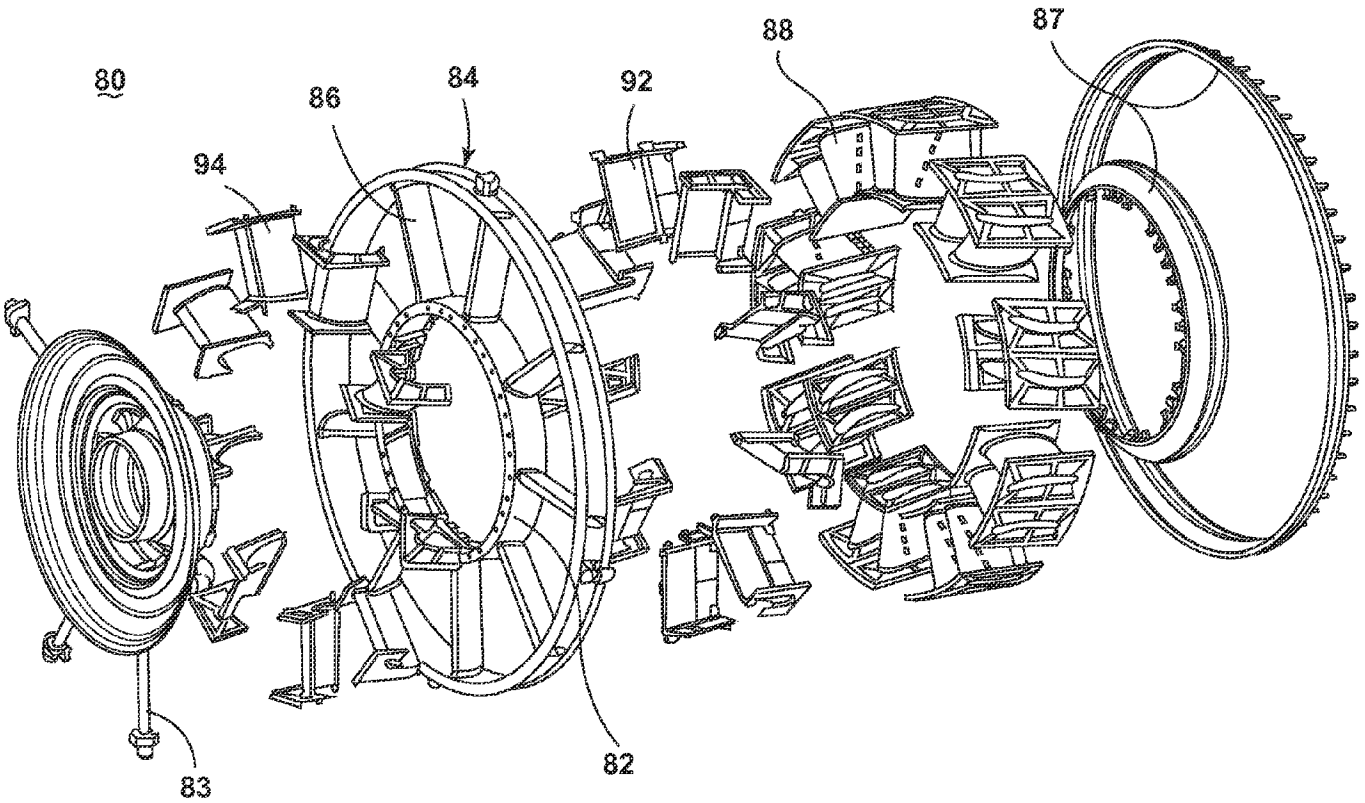
FIG. 3 is an exploded view of the turbine exhaust frame of FIG. 2.

There may be any number of vanes 88 and 90 included in the exhaust frame 80. The vanes 88 and 90 may have airfoil shapes and may create an airfoil cascade. During operation, the vanes 88 and 90 shape the air flow to improve the engine efficiency. The struts 86, which are not an airfoil shape, would negatively impact the airflow; therefore, the vanes 90 are included to form an airfoil around the struts 86. It will be understood that in the illustrated example the vanes 90 surround structural elements, like the struts 86 while the vanes 88 surround nothing. FIG. 3 illustrates an exploded view of the exhaust frame 80 to illustrate this more clearly.

Figure 4:
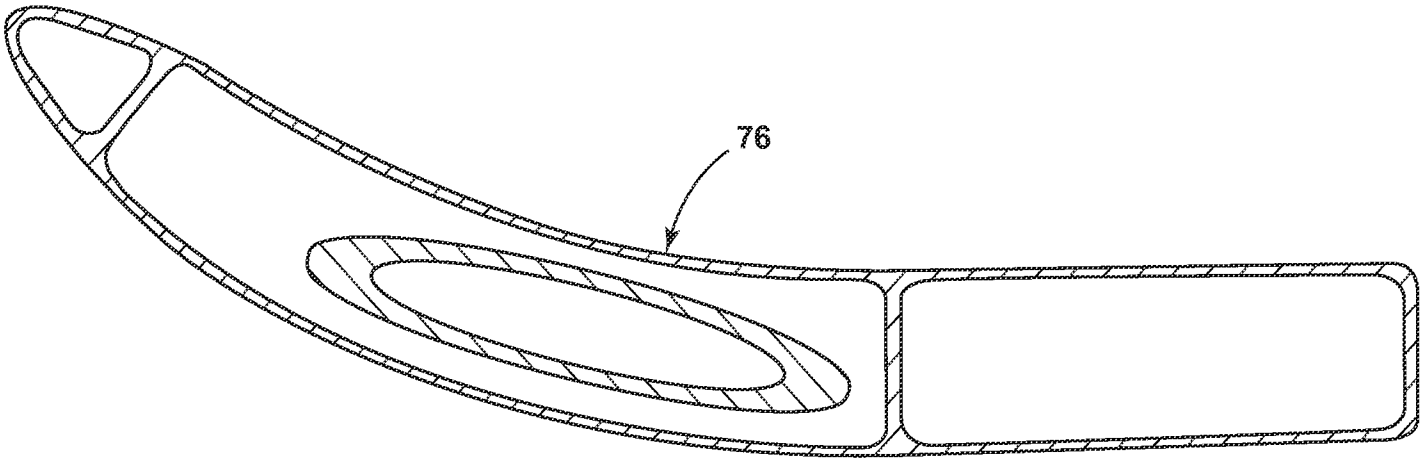
FIG. 4 (PRIOR ART)
FIG. 4 is a cross section of a prior art single-piece airfoil for a turbine frame.
Figure 5:
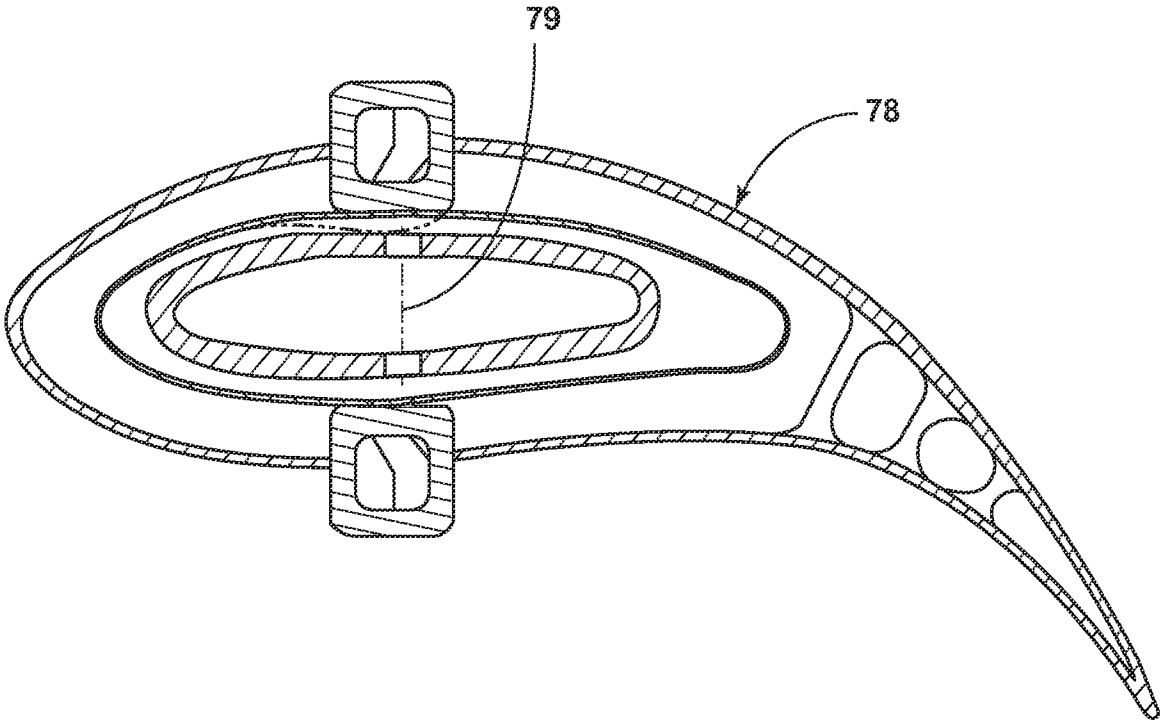
FIG. 5 (PRIOR ART)
FIG. 5 is a cross section of a prior art example of a multi-piece or split airfoil cross section for a turbine frame.

FIGS. 4 and 5 illustrate two prior art aerodynamic vanes that have previously been used to cover struts in conventional engines. FIG. 4 illustrates a prior art turbine vane in the form of a single-piece vane 76 that has an airfoil shape. The single-piece vane 76 required the exhaust frame it is used with to be manufactured in at least two pieces to facilitate assembly. FIG. 5 illustrates an alternative prior art vane 78 that includes a split plane that includes the stacking axis 79. Because the split plane is along the stacking axis 79, the vane 78 requires a greater circumferential thickness, thereby increasing area blockage.

Unlike the prior art vanes, embodiments of the invention include split fairings with the split lines being staggered relative to the frame struts, which enables a reduction in the cross-sectional width of the airfoil to reduce aerodynamic blockage. The airfoil or vane 90 (FIG. 2), which may be included in the exhaust frame 80 may include a first fairing 92 and a second fairing 94. Both the first fairing 92 and a second fairing 94 may be mounted to both the inner hub 82 and the outer hub 84. The first and second fairings 92 and 94 may be mounted to the inner and outer hubs 82 and 84 in any suitable manner including that the first and second fairings 92 and 94 may be directly mounted to the inner and outer hubs 82 and 84 or they may have opposing end plates mounted to a corresponding one of the inner and outer hubs 82 and 84.

Figure 6:
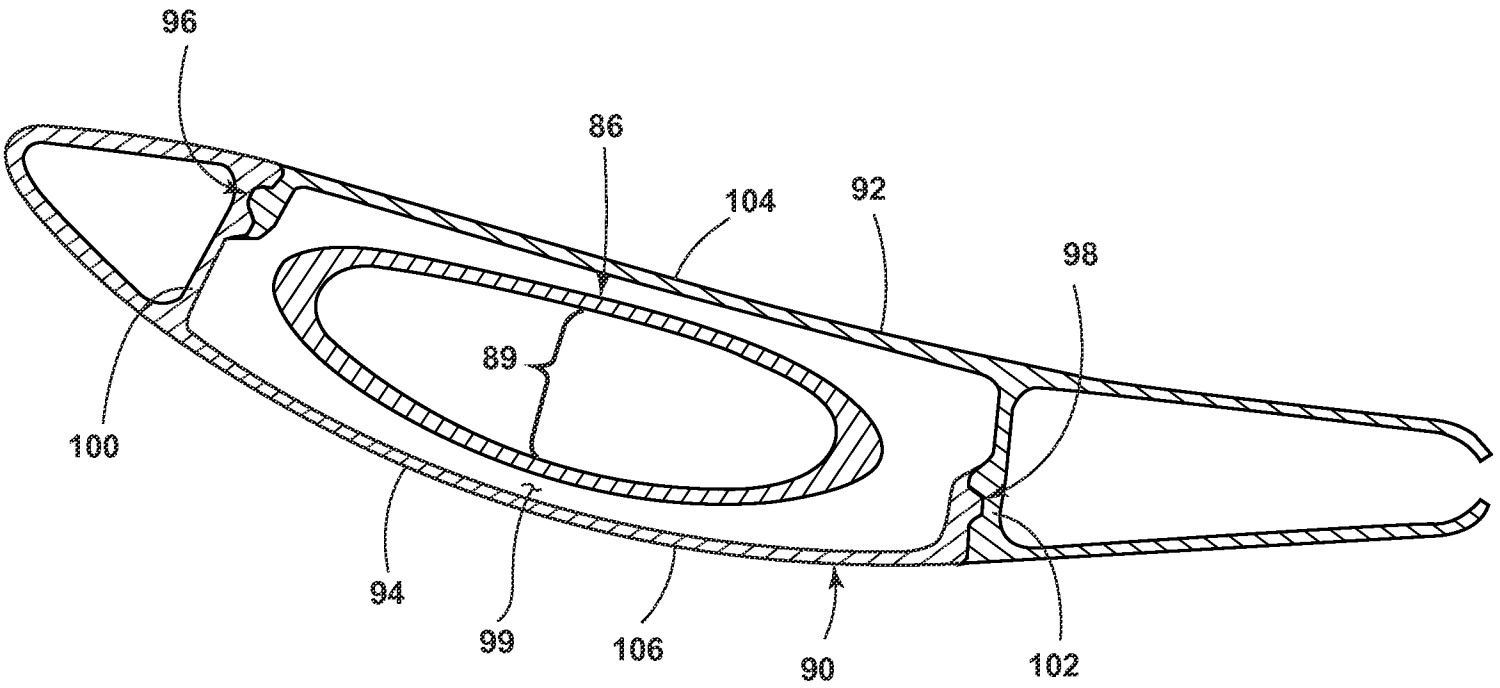
FIG. 6 is a cross-sectional view of an airfoil vane taken along line VI-VI of FIG. 2.

As is more easily seen in FIG. 6, the vane 90 may encircle one of the struts 86 and the first fairing 92 and the second fairing 94 may abut along a first join line 96 and a second join line 98. The first and second fairings 92 and 94 connect together along the first and second join lines 96 and 98 to define an interior 99 sized to receive one of the struts 86.

As illustrated the strut 86 has a maximum width portion 89 and the first and second join lines 96 and 98 are located on axially opposite sides of the maximum width portion 89. The first join line 96 may be located axially forward of the second join line 98. Thus, as illustrated, the first join line 96 is located such that the first join line 96 is forward of the maximum width portion 89 of the strut 86 and the second join line 98 is aft of the maximum width portion 89 when the first and second fairings 92 and 94 are mounted to the exhaust frame 80 and the strut 86 is received within the interior 99.

The width of the vane 90 at either of the first and second join lines 96 and 98 may be less than the width of the maximum width portion 89. This may include that the width of the vane 90 at both of the first and second join lines 96 and 98 is less than the width at the maximum width portion 89. The vane 90 may have any suitable cross section including that the vane 90 may have an asymmetrical cross section as illustrated.

A first stiffener 100 may extend between the first and second fairings 92 and 94 and the first join line 96 may be located at the first stiffener 100. Further, a second stiffener 102 may extend between the first and second fairings 92 and 94 and the second join line 98 may be located at the second stiffener 102. As illustrated, the first and second stiffeners 100 and 102 may be axially spaced from each other and the interior 99 is located between the first and second stiffeners 100 and 102. Both a high pressure surface 104 and a low pressure surface 106 may be formed by the vane 90. As illustrated each of the first and second fairings 92 and 94 form at least a portion of each of the high and low pressure surfaces 104 and 106.

The embodiments described above provide for a variety of benefits including that the split fairings act as covers of the struts of the structural exhaust frame and that a single piece exhaust frame may be utilized. Further, the airfoil includes split lines that are staggered about the struts to minimize the airfoil maximum circumferential thickness, thereby reducing aerodynamic blockage. Thus, the above described embodiments reduce pressure losses resulting in commercial advantages such as reduced frame aerodynamic losses and allowing for increased operating temperatures and increased efficiency.

To the extent not already described, the different features and structures of the various embodiments may be used in combination with each other as desired. That one feature may not be illustrated in all of the embodiments is not meant to be construed that it may not be, but is done for brevity of description. Thus, the various features of the different embodiments may be mixed and matched as desired to form new embodiments, whether or not the new embodiments are expressly described. All combinations or permutations of features described herein are covered by this disclosure.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. An airfoil for a turbine frame having inner and outer hubs connected by a plurality of struts with a maximum width portion relative to an axial center of the turbine frame, the turbine frame having a forward and an aft, the airfoil comprising:

at least first and second fairings connected together along first and second join lines to form the airfoil and define an interior sized to receive one of the struts when the first and second fairings are mounted to the turbine frame;

a low pressure surface; and a high pressure surface;

wherein each of the first and second fairings form at least a portion of each of the low and high pressure surfaces;

wherein the first join line is located such that the first join line is forward of the maximum width portion and the second join line is aft of the maximum width portion when the first and second fairings are mounted to the turbine frame and a strut is received within the interior, and wherein the first fairing comprises more than half of the area of the high pressure surface and the second fairing comprises more than half of the area of the low pressure surface.

2. The airfoil of claim 1 wherein the first join line intersects with the outer periphery of the airfoil on the high pressure surface and the second join line intersects with the outer periphery of the airfoil on the low pressure surface.

3. The airfoil of claim 1 further comprising a first stiffener extending between the first and second fairings and the first join line is located at the first stiffener, wherein the first fairing encapsulates a trailing edge of the airfoil and the second fairing encapsulates a leading edge of the airfoil.

4. The airfoil of claim 3 further comprising a second stiffener extending between the first and second fairings and the second join line is located at the second stiffener.

5. The airfoil of claim 4 wherein the first and second stiffeners are axially spaced from each other and the interior is located between the first and second stiffeners.

6. The airfoil of claim 1 wherein the airfoil has an asymmetrical cross section relative to an axis parallel to the axial direction of the engine.

7. The airfoil of claim 1 wherein the first and second fairings have opposing end plates mounted to a corresponding one of the inner and outer hubs.

8. An airfoil for a turbine frame having radially spaced, inner and outer hubs connected by a plurality of struts with the turbine frame defining an axial centerline, the airfoil comprising:

at least first and second fairings connected together along first and second join lines to form the airfoil and the first join line is located axially forward of the second join line;

a low pressure surface; and a high pressure surface, wherein each of the first and second fairings form at least a portion of each of the low and high pressure surfaces;

wherein the first fairing comprises a majority of the area of the high pressure surface and the second fairing comprises a majority of the area of the low pressure surface.

9. The airfoil of claim 8 further comprising a low pressure surface and a high pressure surface, and each of the first and second fairings form at least a portion of each of the low and high pressure surfaces.

10. The airfoil of claim 8 further comprising a first stiffener extending between the first and second fairings and the first join line is located at the first stiffener.

11. The airfoil of claim 10 further comprising a second stiffener extending between the first and second fairings and the second join line is located at the second stiffener.

12. The airfoil of claim 8 wherein the first and second stiffeners are axially spaced from each other.

13. A turbine frame for a turbine engine having an axial centerline, the turbine frame comprising:

an inner hub;

an outer hub encircling the inner hub;

a first plurality of vanes extending between the inner and outer hubs, the first plurality of vanes comprising:

a plurality of struts extending between the inner and outer hubs and having a maximum width portion relative to the axial centerline;

an airfoil comprising at least first and second fairings mounted to the inner and outer hubs and encircling one of the plurality of struts, and abutting along first and second join lines, with the first join line located axially forward of the second join line;

a low pressure surface of the airfoil; and a high pressure surface of the airfoil, each of the first and second fairings forming at least a portion of each of the low and high pressure surfaces;

wherein the first fairing comprises more than half of the area of the high pressure surface and the second fairing comprises more than half of the area of the low pressure surface;

a second plurality of vanes circumferentially distributed around the turbine frame and extending between the inner and outer hub.

14. The turbine frame of claim 13 wherein each one of the plurality of struts has a maximum width portion and the first and second join lines are located on axially opposite sides of the maximum width portion, wherein the second plurality of vanes comprises a greater number of vanes than the first plurality of vanes.

15. The turbine frame of claim 13 wherein the width of the airfoil at one of the first and second join lines is less than the maximum width portion, wherein the first join line intersects with the outer periphery of the airfoil on the high pressure surface and the second join line intersects with the outer periphery of the airfoil on the low pressure surface; and wherein the first fairing encapsulates a trailing edge of the airfoil and the second fairing encapsulates a leading edge of the airfoil.

16. The turbine frame of claim 15 wherein the width of the airfoil at each of the first and second join lines is less than the maximum width portion.

17. The turbine frame of claim 15 further comprising a first stiffener extending between the first and second fairings and the first join line is located at the first stiffener, wherein the airfoil has an asymmetrical cross section relative to an axis parallel to the axial direction.

18. The turbine frame of claim 17 further comprising a second stiffener extending between the first and second fairings and the second join line is located at the second stiffener.

19. The turbine frame of claim 18 wherein the first and second stiffeners are axially spaced from each other and an interior is located between the first and second stiffeners.

20. The turbine frame of claim 19 wherein the first and second fairings have opposing end plates mounted to a corresponding one of the inner and outer hubs.

* * * * *